US007861542B2

(12) United States Patent
Rozendaal et al.

(10) Patent No.: US 7,861,542 B2
(45) Date of Patent: Jan. 4, 2011

(54) REFRIGERATOR INCLUDING FOOD PRODUCT MANAGEMENT SYSTEM

(75) Inventors: Joel Rozendaal, Lynnville, IA (US); John Francis Broker, Warrenton, MO (US)

(73) Assignee: Maytag Corporation, Benton Harbor, MI (US)

( * ) Notice: Subject to any disclaimer, the term of this patent is extended or adjusted under 35 U.S.C. 154(b) by 740 days.

(21) Appl. No.: 11/733,491

(22) Filed: Apr. 10, 2007

(65) Prior Publication Data

US 2008/0250797 A1 Oct. 16, 2008

(51) Int. Cl.
*F25B 49/00* (2006.01)

(52) U.S. Cl. ..... 62/127; 62/129; 62/157; 62/231; 236/54

(58) Field of Classification Search ..... 62/264, 62/127, 129, 157, 231; 422/22, 24; 426/237; 236/51

See application file for complete search history.

(56) References Cited

U.S. PATENT DOCUMENTS

| | | | | |
|---|---|---|---|---|
| 3,818,858 | A | 6/1974 | Kramer et al. | |
| 5,243,579 | A | 9/1993 | Potthof | |
| 5,335,509 | A | 8/1994 | Namisniak et al. | |
| 5,487,276 | A | 1/1996 | Namisniak et al. | |
| 5,711,160 | A | 1/1998 | Namisniak et al. | |
| 5,798,694 | A * | 8/1998 | Reber et al. | 340/540 |
| 5,802,015 | A | 9/1998 | Rothschild et al. | |
| 6,000,159 | A | 12/1999 | Hornung | |
| D449,644 | S | 10/2001 | Klassen | |
| 6,741,523 | B1 | 5/2004 | Bommarito et al. | |
| 6,787,108 | B2 | 9/2004 | Ribi | |
| 6,817,192 | B2 | 11/2004 | Ector, Jr. et al. | |
| 6,822,931 | B2 | 11/2004 | Braunberger | |
| 6,892,545 | B2 | 5/2005 | Ishikawa et al. | |
| 6,919,795 | B2 | 7/2005 | Roseen | |
| 6,982,640 | B2 | 1/2006 | Lindsay et al. | |
| 2002/0066279 | A1 | 6/2002 | Kiyomatsu | |
| 2004/0085225 | A1 | 5/2004 | Wilson | |
| 2004/0104141 | A1 | 6/2004 | Norrby et al. | |
| 2004/0257918 | A1 | 12/2004 | Ribi | |

(Continued)

FOREIGN PATENT DOCUMENTS

| | | |
|---|---|---|
| JP | 10311665 | 11/1998 |

(Continued)

*Primary Examiner*—Cheryl J Tyler
*Assistant Examiner*—Jonathan Bradford
(74) *Attorney, Agent, or Firm*—Kirk W. Goodwin; John W. Morrison; Diederiks & Whitelaw PLC

(57) ABSTRACT

A refrigerator includes at least one refrigerated compartment and a food product management system. The food product management system includes a container for storing foodstuffs in the at least one refrigerated compartment. The container includes a storage zone and a lid. A tag is arranged on the container to provide a consumer with an indication of whether a food item stored in the container is or is not spoiled. The tag can include a timer having a display, an indicator that changes state upon the passage of a predetermined time period and a computer that notifies a consumer, such as through an email, about a parameter associated with the food item in the container. The tag is affixed to the container with adhesive, snaps, clips, hooks and the like or, alternatively, simply integrally formed with the container.

13 Claims, 3 Drawing Sheets

U.S. PATENT DOCUMENTS

| | | | | |
|---|---|---|---|---|
| 2005/0037498 | A1 | 2/2005 | Ribi | |
| 2005/0141348 | A1 | 6/2005 | Adamy | |
| 2005/0236293 | A1 | 10/2005 | Turvey et al. | |
| 2005/0258961 | A1 * | 11/2005 | Kimball et al. | 340/572.1 |
| 2005/0286350 | A1 | 12/2005 | Wien | |
| 2006/0032774 | A1 | 2/2006 | Norrby et al. | |
| 2006/0057022 | A1 | 3/2006 | Williams et al. | |
| 2006/0061454 | A1 | 3/2006 | Debord et al. | |

FOREIGN PATENT DOCUMENTS

| | | |
|---|---|---|
| JP | 2000/121239 | 4/2000 |
| JP | 2005/030730 | 2/2005 |

* cited by examiner

REFRIGERATOR INCLUDING FOOD PRODUCT MANAGEMENT SYSTEM

BACKGROUND OF THE INVENTION

1. Field of the Invention

The present invention pertains to the art of refrigerators and, more particularly, to a refrigerator incorporating a food product management system.

2. Description of the Related Art

Relying on refrigeration to prevent food spoilage is widely known in the art. In order to further prevent, or at least slow, food spoilage, most consumers store food stuffs in air-tight containers or wrapped in plastic. Unfortunately, over time, the contents of the container or plastic wrap will still spoil. Food spoilage can be attributed, at least in many circumstances, to a consumer forgetting the date on which a particular container was placed in the refrigerator and therefore failing to consume the food prior to spoiling.

In order to enable better tracking of stored foodstuffs, there are several devices available to consumers. These devices range from simple indicators or timers to more complex computerized systems. In one example, a dial indicator is provided on a container lid. The dial indicator enables a consumer to establish a date, e.g., month/day, that the foodstuff was placed into the container and refrigerated. Alternatively, the consumer can set a date that the foodstuff is expected to expire. In another example, a timer having an LCD display is attached to a container. The timer counts down lapsed days, hours and minutes. In yet another example, food items are provided with radio frequency identification (RFID) tags that are scanned by an RFID reader. The RFID reader forwards information obtained from the RFID tags to a console provided on the refrigerator which stores relevant information, such as food type, the date of refrigeration and an anticipated date of expiration.

Regardless of these prior proposed arrangements, there still exists a need for a food product management system that can easily and accurately track the shelf life of foodstuffs in a refrigerator. More specifically, there exists a need for a simple, low cost food monitoring and management system that requires little interaction from a consumer to set, monitor and read expiration information pertaining to particular food items stored in a refrigerator.

SUMMARY OF THE INVENTION

The present invention is directed to a refrigerator including a food product management system. In accordance with the invention, the food product management system includes a container for storing foodstuffs in the refrigerator. Preferably, the container includes a central storage zone and a lid. A tag is provided on the container that provides a consumer with an indication of a storage duration or a time period until the food item reaches an expiration date.

In accordance with one embodiment of the invention, the tag includes a timer having a display that indicates the passage of days, hours and/or minutes, with the timer being activated only upon reaching a predetermined, below ambient temperature. That is, once the tag reaches a predetermined refrigerated temperature, the timer automatically activates. In this manner, a consumer can simply read the display to learn how long a particular container has been stored. Alternatively, a time period can be programmed into the tag, either by the consumer or through a pre-programming operation. When using programmed time periods, the timer automatically starts counting down upon reaching the predetermined refrigerated temperature. The timer can be reset either manually or automatically, such as upon reaching ambient temperature.

In accordance with another embodiment of the invention, the tag includes an indicator that signals the passage of a predetermined time period. That is, upon the passage of the predetermined time period, the indicator changes from a first state indicating that the predetermined time period has not lapsed, to a second state indicating that expiration of the predetermined time period is approaching, and then to a third state indicating that the predetermined time period has lapsed. With this arrangement, a consumer can apply a tag having an indication corresponding to the time period closest to expiration of the food item. Once the time period has lapsed, the indication changes state to signal the consumer that the food item may no longer be of acceptable quality. Alternatively, the consumer can program the tag for various desired time periods. Finally, the tag can be either integrally formed with the container, attached to the container with adhesive or provided with a mechanical element, such as a snap, hook clip or the like, that selectively connects to one of the container and the container lid.

In accordance with still another embodiment of the invention, the food product management system includes a computer operatively connected to the internet. The computer or controller includes, in accordance with one aspect of the invention, an RFID detector that reads or scans RFID units located in the tag as the container is placed in the refrigerator. The RFID unit contains information pertaining to at least one parameter of the container or foodstuff stored therein. In accordance with another aspect of the invention, the computer includes a universal bar code reader that scans a universal bar code attached to each container. In a manner similar to that described above, the universal bar code contains information pertaining to at least one parameter of the container or foodstuff stored therein. In accordance with another aspect of the invention, the consumer can manually program information pertaining to the container and/or foodstuff into the computer. In any event, at select times, the computer generates an email notification to the consumer regarding the information pertaining to the at least one parameter of the container and/or foodstuff. For example, the computer can, through an email notification, alert the consumer that an expiration date of a particular foodstuff is approaching.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
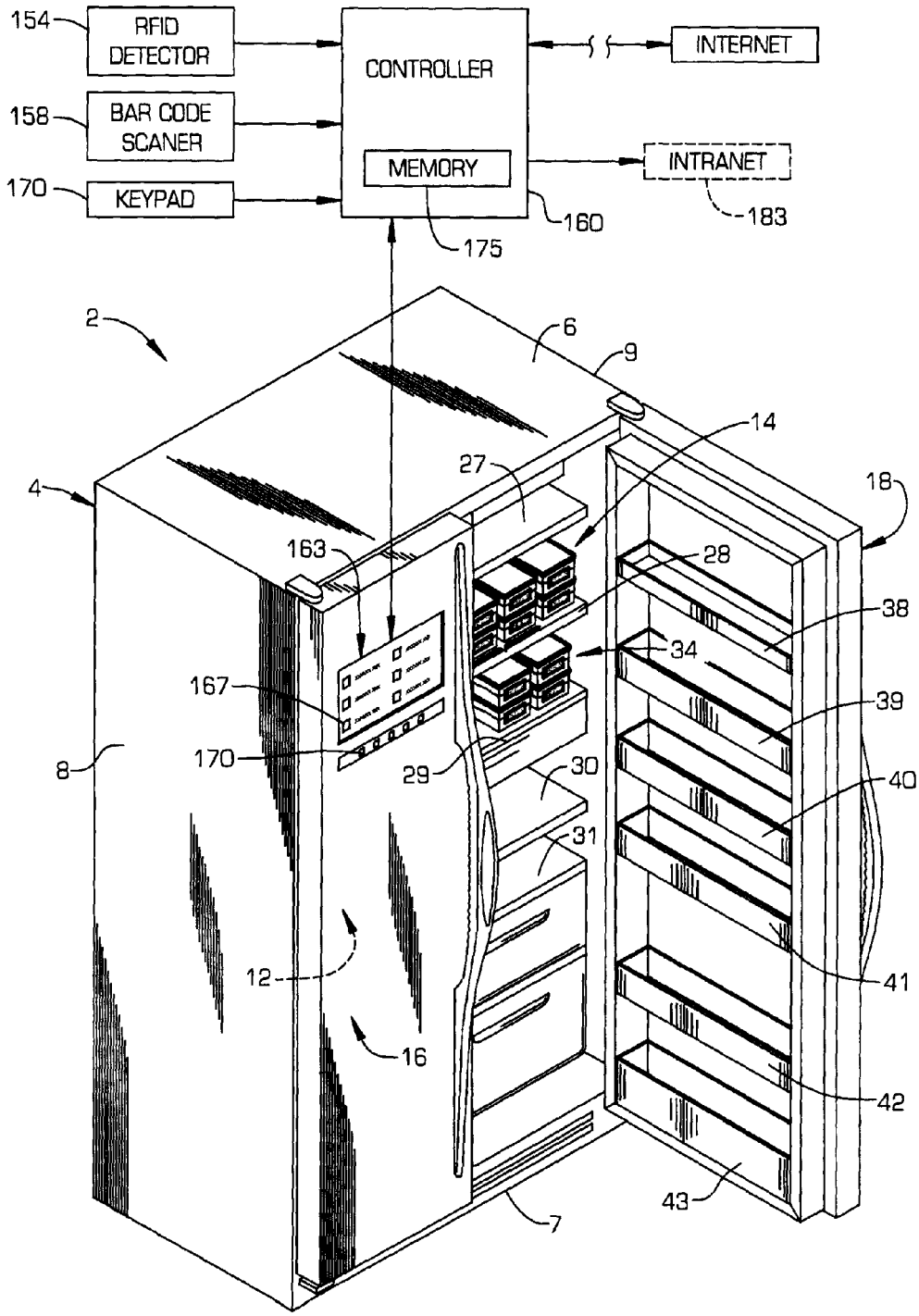
FIG. 1 is an upper left perspective view of a refrigerator incorporating a food product management system including one or more tags that track, for example, an expiration date of a food item in accordance with the present invention.

With initial reference to FIG. 1, a refrigerator 2 constructed in accordance with the present invention includes a cabinet 4 having a top wall 6, a bottom wall 7 and opposing side walls 8 and 9. In a manner known in the art, refrigerator 2 includes a freezer compartment 12 and a fresh food compartment 14, with each of freezer compartment 12 and fresh food compartment 14 having an associated freezer compartment door 16 and fresh food compartment door 18 respectively. As shown, refrigerator 2 includes a plurality of shelves 27-31 arranged within fresh food compartment 14 for supporting a variety of containers, one of which is indicated at 34, that store various food items. Refrigerator 2 also includes a plurality of storage bins/shelves 38-43 supported on an inner liner (not separately labeled) of fresh food compartment door 18. Of course, it should be understood that freezer compartment 12 and freezer compartment door 16 can include a corresponding plurality of shelves and/or storage bins (not shown). In any event, as best shown in FIG. 2, container 34 includes a main body portion 60 having an exterior wall 61 that defines an interior cavity 63 which is adapted to receive foodstuff(s) and selectively sealed by a lid 66 to maintain freshness of the foodstuff(s) stored therein.

Figure 2:
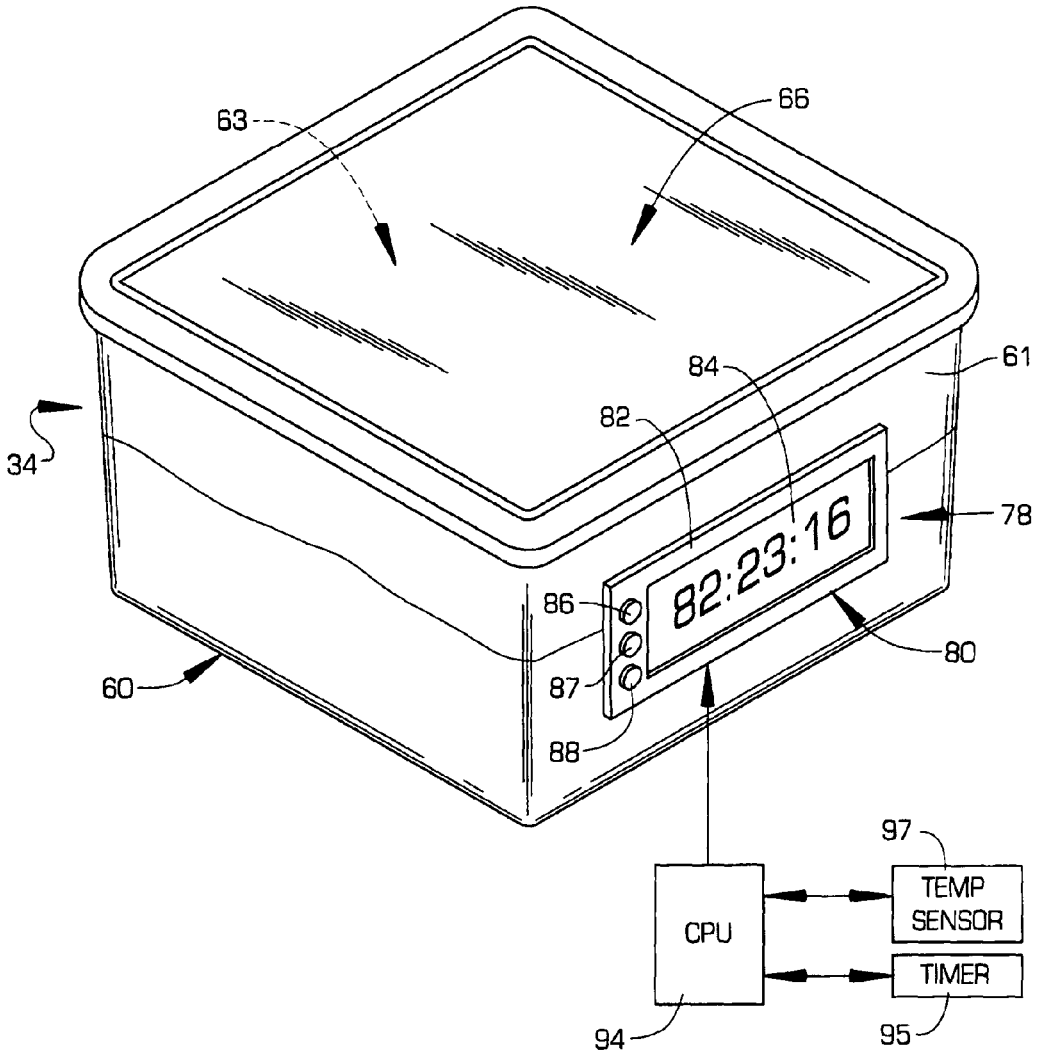
FIG. 2 is an upper left perspective view of a container including a tag constructed in accordance with the first embodiment of the present invention.

In accordance with the embodiment of FIG. 2, refrigerator 2 includes a food product management system 78 including a notification device or a tag 80 mounted to container 34. Tag 80 is provided with a main body 82 that is preferably fixed to exterior wall 61 of container 34. Of course, it should be readily understood that tag 80 could also be mounted to lid 66 or any other surface of container 34. In any event, tag 80 includes a display 84 and a plurality of control elements 86-88 which enable consumers to program a built-in controller or CPU 94 with a particular time duration. More specifically, control elements 86-88 enable a consumer to program CPU 94 to control a timer 95. Timer 95 can be programmed to count days, hours and/or minutes which correlate to an expected expiration date for the food item stored within container 34. Preferably, tag 80 further includes a temperature sensor 97 operatively associated with CPU 94 which controls the activation and deactivation of timer 95. More specifically, timer 95 remains inactive until container 34 reaches a predetermined, refrigerated temperature that is preset within CPU 94. Once the predetermined temperature has been reached, timer 95 begins to either countdown or count up to the programmed time period. In this manner, a consumer can, at a quick glance, determine how long before a particular food item will expire so as to ensure use of the food item in a timely manner. After container 34 has been removed from fresh food compartment 14, tag 80 gradually returns to ambient temperature. In further accordance with the invention, once sensor 97 determines that tag 80 has reached a temperature above the predetermined temperature, e.g., an ambient temperature in the order of 65° F. (18° C.), CPU 94 automatically resets timer 95, thereby allowing the consumer to re-program tag 80 or set aside for future use.

Figure 3:
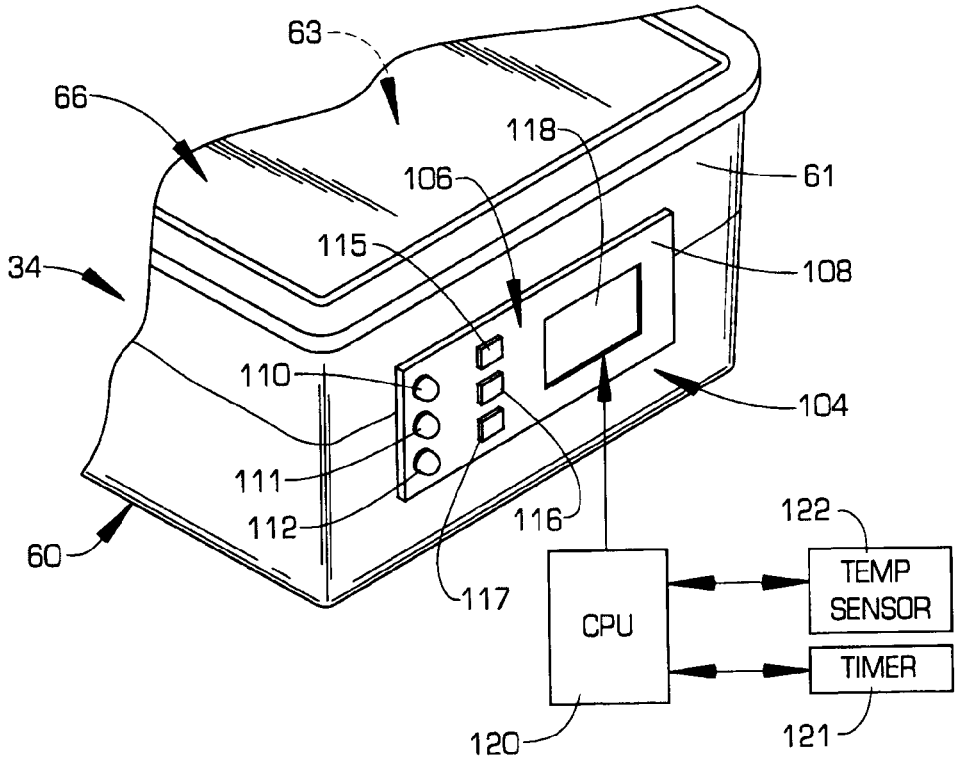
FIG. 3 is a partial, upper left perspective view of a container incorporating a tag constructed in accordance with a second embodiment of the present invention.

Reference will now be made to FIG. 3, wherein like reference numbers represent corresponding parts, in describing a food product management system 104 constructed in accordance with a second embodiment of the present invention. As shown, food product management system 104 includes a tag 106 having a main body 108 that is secured to exterior wall 61 of container 34. Tag 106 includes a plurality of indicators 110-112, preferably lights such as LEDs, and a corresponding plurality of control elements 115-117. In accordance with one aspect of the invention, tag 106 includes a display 118 that can be used by a consumer to program a CPU 120 through the plurality of control elements 115-117. That is, a consumer can program tag 106 with a predetermined time period associated with, for example, an expiration date of a food item stored within container 34. In a manner similar to that described above, CPU 120 includes a timer 121 and a temperature sensor 122, with timer 121 being activated upon temperature sensor 122 reaching a predetermined, refrigerated temperature. At an initial portion of the programmed time period, indicator 110 is active or illuminated. Preferably, indicator 110 is green in color. The color green represents that the contents of container 34 are fresh and the expiration date of the food item far off. As the expiration date approaches, indicator 110 is extinguished and indicator 111 is activated. Preferably indicator 111 is yellow in color. The color yellow would represent that the food item is still relatively fresh, but the expiration date is nearing. For example, indicator 111 is activated three days prior to the expiration date. Once the programmed time period has lapsed, e.g., the expiration date has been reached, indicator 111 is extinguished and indicator 112 is activated. Preferably, indicator 112 is red in color, with the color red representing that the foodstuff within container 34 is no longer fresh and should, most probably, be discarded.

Figure 4:
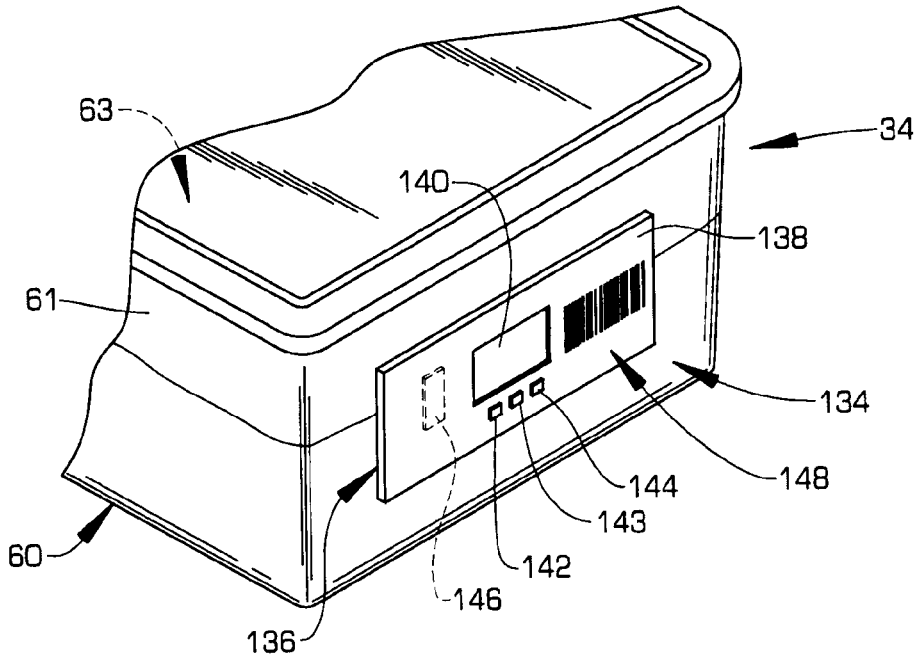
FIG. 4 is an upper left perspective view of a container incorporating a tag constructed in accordance with a third embodiment of the present invention.

Reference will now be made to FIG. 4, wherein like reference numbers represent corresponding parts, in describing a food product management system 134 constructed in accordance with yet another embodiment of the present invention. As shown, food product management system 134 includes a tag 136 having a main body 138 upon which is provided a display 140, as well as a plurality of control elements 142-144. In addition, tag 136 includes an RFID device 146 positioned within main body 138. RFID device 146 is programmed with at least one foodstuff parameter, preferably an expiration date associated with a particular food item. In accordance with one aspect of the invention, the at least one food stuff parameter is programmed into RFID device 146 through the plurality of control elements 142-144 and reviewed on display 140. Tag 136 is also shown to include a bar code 148 which, in a manner that will be described more fully below, also includes information regarding the foodstuff parameter. In any event, in a manner that will be described more fully below, as container 34 is placed within refrigerator 2, RFID detector 154 (also see FIG. 1) reads the at least one foodstuff parameter from RFID device 146. In an alternative configuration, instead of RFID devices, food product management system 134 includes a bar code scanner 158 that is employed to scan bar code 148.

The foodstuff parameter contained within RFID detector 154 or bar code 158 is passed to a controller 160 that is operatively connected to a computer 163 mounted to freezer compartment door 16. Computer 163 includes a display 167 which may include touch screen elements (not separately labeled) or, alternatively, is provided with a keypad 170. The foodstuff parameter is stored within a memory 175 that is operatively associated with controller 160. In accordance with this embodiment, computer 163 is operatively connected to the internet such that, once an expiration date of a food item approaches, controller 160 forwards an email, via the internet, to the consumer indicating that a food item is about to expire. Alternatively, controller 160 can forward the information via an intranet or home network 183. In addition, controller 160 can present on display 163 information regarding the approaching expiration date of one or more food items residing within fresh food compartment 14.

At this point, it should be understood that the food product management system constructed in accordance with the present invention enables a consumer to readily ascertain when a particular food item stored within a container is approaching an expiration date. In this manner, the consumer can schedule to consume the particular food item prior to the expiration or readily ascertain that the expiration date has passed and simply discard the food item. Although described with reference to preferred embodiments of the invention, it should be readily understood that various changes and/or modifications can be made to the invention without departing from the spirit thereof. For instance, while each tag is described as being programmed with a particular time period, it should be readily understood that tags can come preprogrammed and readily affixed to containers based on an expiration date of the food item stored within the container. In addition, while described in terms of containers placed within a fresh food compartment, the containers can also be placed and monitored within the freezer compartment of the refrigerator. Furthermore, it should be readily understood that each tag can be integrated into the main body or lid of a respective container, or attached thereto through the use of any known arrangement, such as an adhesive or various mechanical fasteners including snaps, clips, and the like. It should be realized that the embodiments of the invention as described above can be used in combination, e.g., the RFID arrangement can be used with the indicator lights. Finally, although the use of a plurality of indicator lights has been disclosed to provide the preferred, sequential green, yellow, red color change, a single indicator, such as a multi-color LED, could be employed. In general, the invention is only intended to be limited by the scope of the following claims.

We claim:

1. A refrigerator comprising:

a cabinet shell;

a liner arranged within the cabinet shell defining at least one refrigerated compartment; and a food product management system including:

a container including a lid for storing foodstuffs in the at least one refrigerated compartment;

a tag provided on the container for indicating a storage duration of a food product placed in the container;

a timer operatively associated with the tag, said timer counting a passage of at least one of days, hours and minutes, said timer being automatically activated upon the tag being cooled to a predetermined temperature, which is below ambient temperature, and automatically deactivated when a temperature above the predetermined temperature is reached;

a computer operatively connected to the internet;

an RFID detector operatively connected to the computer;

an RFID unit located on the tag and containing information pertaining to at least one foodstuff parameter wherein, upon being placed in a refrigerator, said RFID unit is scanned by the RFID detector for the at least one foodstuff parameter, said computer being adapted to automatically generate an email notification to a consumer regarding the least one foodstuff parameter after a certain period of time on the timer has elapsed; and an indicator arranged on the tag signaling passage of a predetermined time period, said indicator changing from a first state prior to the predetermined time period lapsing, to a second state upon reaching the predetermined time period.

2. A refrigerator comprising:

a cabinet shell;

a liner arranged within the cabinet shell defining at least one refrigerated compartment; and a food product management system including:

a tag for indicating a storage duration of a food product;

a timer operatively associated with the tag, said timer counting a passage of at least one of days, hours and minutes, said timer being automatically activated upon the tag being cooled to a predetermined temperature which is below ambient temperature and automatically deactivated when a temperature above the predetermined temperature is reached; and an indicator arranged on the tag signaling passage of a predetermined time period, said indicator changing from a first state prior to the predetermined time period lapsing, to a second state upon reaching the predetermined time period.

3. The refrigerator according to claim 2, wherein the indicator is constituted by a display presenting a numeric representation of at least one of days, hours and minutes.

4. The refrigerator according to claim 2, further comprising: a plurality of control elements arranged upon the tag, said plurality of control elements being adapted to program the timer with the predetermined time period.

5. The refrigerator according to claim 2, wherein the indicator is constituted by a plurality of lights, each of the plurality of lights being illuminated to progressively signal passage of the predetermined time period.

6. The refrigerator according to claim 5, wherein the tag includes a plurality of control elements, said plurality of control elements being adapted to program the timer with the predetermined time period.

7. The refrigerator according to claim 6, wherein the tag includes a display for reviewing the predetermined time period input through the plurality of control elements.

8. The refrigerator according to claim 2, further comprising:

a controller provided in the tag and operatively connected to the timer; and a temperature sensor operatively connected to the controller, said temperature sensor being adapted to sense the predetermined temperature and signal the controller to activate the timer.

9. A refrigerator comprising:

a cabinet shell;

a liner arranged within the cabinet shell defining at least one refrigerated compartment; and a food product management system including:

a tag having a visual indicator for indicating a storage duration of a food product;

a timer operatively associated with the tag, said timer counting a passage of at least one of days, hours and minutes, said timer being automatically activated upon the tag being cooled to a predetermined temperature which is below ambient temperature and automatically deactivated when a temperature above the predetermined temperature is reached;

a computer operatively connected to the internet;

an RFID detector operatively connected to the computer; and an RFID unit located on the tag and containing information pertaining to at least one foodstuff parameter wherein, upon being placed in a refrigerator, said RFID unit is scanned by the RFID detector for the at least one foodstuff parameter, said computer being adapted to automatically generate an email notification to a consumer regarding the least one foodstuff parameter.

10. The refrigerator according to claim 9, further comprising: a plurality of control elements arranged upon the tag, said plurality of control elements being adapted to program the tag with the at least one foodstuff parameter.

11. The refrigerator according to claim 10, further comprising: a display for reviewing the at least one foodstuff parameter input through the plurality of control elements.

12. The refrigerator according to claim 11, wherein the at least one foodstuff parameter is constituted by an expiration date associated with a particular food item.

13. The refrigerator according to claim 9, further comprising:

a bar code scanner supported by the cabinet shell; and a bar code provided on the tag, said bar code containing the at least one foodstuff parameter.

* * * * *